US006116345A

United States Patent [19]

Fontana et al.

[11] Patent Number: 6,116,345

[45] Date of Patent: Sep. 12, 2000

[54] TUBING INJECTION SYSTEMS FOR OILFIELD OPERATIONS

[75] Inventors: Peter Fontana, Houston, Tex.; Philip Burge, The Hague, Netherlands

[73] Assignee: Baker Hughes Incorporated, Houston, Tex.

[21] Appl. No.: 08/911,787

[22] Filed: Aug. 14, 1997

Related U.S. Application Data

[63] Continuation-in-part of application No. 08/825,000, Mar. 26, 1997, which is a continuation-in-part of application No. 08/543,683, Oct. 16, 1995, which is a continuation-in-part of application No. 08/524,984, Sep. 8, 1995, abandoned, which is a continuation of application No. 08/402,117, Mar. 3, 1995, abandoned.

[60] Provisional application No. 60/027,140, Oct. 1, 1996.

[51] Int. Cl.[7] ..... E21B 19/08

[52] U.S. Cl. ..... 166/343; 166/77.1; 166/77.3; 166/360

[58] Field of Search ..... 166/343, 360, 166/77.1, 77.2, 77.3, 378, 379, 380

[56] References Cited

U.S. PATENT DOCUMENTS

| | | |
|---|---|---|
| 1,656,215 | 1/1928 | McDonald et al. . |
| 1,886,209 | 11/1932 | Vest . |
| 2,555,851 | 6/1951 | Hancock . |
| 2,797,880 | 7/1957 | Miller et al. . |
| 2,960,311 | 11/1960 | Scott . |

(List continued on next page.)

FOREIGN PATENT DOCUMENTS

| | | |
|---|---|---|
| 890228 | 1/1972 | Canada . |
| 2.055.781 | 4/1971 | France . |
| 1189033 | 3/1965 | Germany . |
| 1 945 590 | 3/1970 | Germany . |
| 1945590 | 3/1970 | Germany . |
| 955193 | 4/1964 | United Kingdom . |
| 996063 | 6/1965 | United Kingdom . |
| 1059932 | 2/1967 | United Kingdom . |
| 1107493 | 3/1968 | United Kingdom . |
| 2 183 600 | 6/1987 | United Kingdom . |
| 2 238 294 | 5/1991 | United Kingdom . |
| 2 247 260 | 2/1992 | United Kingdom . |
| 2247260 | 2/1992 | United Kingdom . |
| WO92/18741 | 10/1992 | WIPO . |
| 96/00359 | 1/1996 | WIPO . |
| WO96/00359 | 1/1996 | WIPO . |
| 96/28633 | 9/1996 | WIPO . |

OTHER PUBLICATIONS

"Flexdrill development nears successful completion." *World Oil*, pp. 127–130, 133 (Jul. 1977).

"Shell pressing coiled tubing programs in California." *Oil & Gas Journal*, pp. 31–32 (Jun. 27, 1994).

Phil Burge "Modular Rig System—Advances in CTD/SJD Rigs." *2nd European Coiled Tubing Roundtable SPE Aberdeen Section + ICoTA* (Oct. 17–18, 1995).

(List continued on next page.)

*Primary Examiner*—William Neuder
*Attorney, Agent, or Firm*—Madan, Mossman, & Sriram P.C.

[57] ABSTRACT

This invention provides a tubing injection system that contains one injector for moving a tubing from a source thereof to a second injector. The second injector moves the tubing into the wellbore. In an alternative embodiment for subsea operations, the system may contain a first injector placed under water over the wellhead equipment for moving the tubing to and from the wellbore. A second injector at the surface moves the tubing to the first injector and a third injector moves the tubing from the tubing source to the second injector. In each of the tubing injection systems sensors are provided to determine the radial force on the tubing exerted by the injectors, tubing speed, injector speed, and the back tension on the source. A control unit containing a computer continually maintains the tubing speed, tension and radial pressure on the tubing within predetermined limits. The control unit is programmed to automatically control the operation of the tubing injection systems according to programs or models provided to the control unit.

48 Claims, 9 Drawing Sheets

U.S. PATENT DOCUMENTS

| | | | |
|---|---|---|---|
| 3,009,521 | 11/1961 | Failing . | |
| 3,313,346 | 4/1967 | Cross . | |
| 3,363,880 | 1/1968 | Blagg . | |
| 3,494,211 | 2/1970 | Reynard et al. . | |
| 3,504,866 | 4/1970 | Palynchuk et al. . | |
| 3,614,019 | 10/1971 | Slator . | |
| 3,638,288 | 2/1972 | Pryor . | |
| 3,841,407 | 10/1974 | Bozeman . | |
| 3,872,932 | 3/1975 | Gosselin . | |
| 3,884,311 | 5/1975 | Eddy . | |
| 4,154,310 | 5/1979 | Konstantinovsky . | |
| 4,463,814 | 8/1984 | Horstmeyer et al. . | |
| 4,515,220 | 5/1985 | Sizer et al. . | |
| 4,577,693 | 3/1986 | Graser | 166/338 |
| 4,585,061 | 4/1986 | Lyons et al. . | |
| 4,655,291 | 4/1987 | Cox . | |
| 4,899,823 | 2/1990 | Cobb et al. . | |
| 5,002,130 | 3/1991 | Laky . | |
| 5,094,340 | 3/1992 | Avakov . | |
| 5,133,405 | 7/1992 | Elliston . | |
| 5,215,151 | 6/1993 | Smith et al. . | |
| 5,234,053 | 8/1993 | Connell . | |
| 5,244,046 | 9/1993 | Council et al. . | |
| 5,287,921 | 2/1994 | Blount et al. . | |
| 5,291,956 | 3/1994 | Mueller et al. . | |
| 5,309,990 | 5/1994 | Lance . | |
| 5,311,952 | 5/1994 | Eddison et al. . | |
| 5,339,913 | 8/1994 | Rives . | |
| 5,370,180 | 12/1994 | Barbee . | |
| 5,553,668 | 9/1996 | Council et al. | 166/77.3 |
| 5,738,173 | 4/1998 | Burge et al. | 166/77.3 |
| 5,799,731 | 9/1998 | Avakov et al. | 166/77.2 |

OTHER PUBLICATIONS

"Use of coiled tubing fans out among well sites of the world." Oil & Gas Journal, pp. 18–25, (Oct. 3, 1994).

Sas–Jaworsky, Alexander: *Coiled Tubing—Operations and Services*; pp. 41–47; Nov. 1991; World Oil, vol. 212, No. 11.

"Flexdrill development nears successful completion." World Oil., pp. 127–130, 133 (Jul. 1997).

"Shell pressing coiled tubing programs in California." Oil & Gas Journal. pp. 31–32 (Jun. 27, 1994).

Phil Burge "Modular Rig System—Advances in CTD/SJD Rigs." 2nd European Coiled Tubing Roundtable SPE Aberdeen Section + ICoTA (Oct. 17–18, 1995).

40
146
56
10
52
50
54a
54b
44a
44b
142
48a
48
48b
h
30
200
270
163
122
124
164
20
12
500
142
65
86
18
17
21
60
170
19
TUBING REEL
84
14
HYDRAULIC POWER UNIT
CONTROL SYSTEM (UNIT)
64
16
62
80

300
332
REEL TEN.
334
TUBING SPEED
336
TUBING GUIDANCE SENSORS
338
OTHER SURFACE SENSORS
337a
337
PREAMP
315
OTHER DEVICES
312
DISPLAY
337b
346
OTHER SURF. HYD. OP. DEVICES
342
REEL
340
FIRST INJECTOR
348
THIRD INJECTOR
320
RECORDER
314
324
ELECTRICALLY OPERATED VALVES
HYDRAULIC POWER UNIT
322
CONTROL UNIT
310
ALARMS
S1
S2
Sn
PREAMP
360
352
INJECTOR
354
LUBRICATOR
356
BOP STACK
358
OTHER UNDERWATER ELEMENTS

TUBING INJECTION SYSTEMS FOR OILFIELD OPERATIONS

CROSS REFERENCE TO RELATED APPLICATIONS

This application takes priority from United States Provisional Patent Application Ser. No. 60/027,140, filed on Oct. 1, 1996. This application further is a continuation-in-part of U.S. patent application Ser. No. 08/825,000, filed on Mar. 26, 1997, which is a continuation-in-part of U.S. patent application Ser. No. 08/543,683, filed on Oct. 16, 1995, which is a continuation-in-part of U.S. patent application Ser. No. 08/524,984, filed on Sep. 8, 1995, now abandoned, which was a continuation of U.S. patent application Ser. No. 08/402,117, filed on Mar. 3, 1995, now abandoned. Each of the above-noted applications are incorporated herein by reference as if fully set forth herein.

FIELD OF THE INVENTION

This invention relates generally to tubing injection systems for use in drilling and/or servicing wellbores and more particularly to a novel land and under-water tubing injection systems and novel injector heads which are also remotely and automatically controllable for running tubings and bottom hole assemblies into wellbores.

BACKGROUND OF THE ART

Drilling rigs and workover rigs are utilized to run drill pipes, production pipes or casings into wellbores during the drilling or servicing operations. Such rigs are expensive and the drilling and service operations are time-consuming. To reduce or minimize the time and expense involved in using jointed pipes or jointed tubing, operators often use coiled-tubing instead to perform drilling and/or workover operations.

During the early applications of coiled-tubings, relatively small coiled tubings (typically approximately one inch in outer diameter) were used. Use of a small diameter coiled-tubing limits the amount of fluid that can be injected downhole, the amount of compression force that can be transmitted through the coiled-tubing to the bottomhole assembly, the amount of tension that can be placed on the coiled-tubing, the amount of torque that the tubing can withstand, type and weight of the tools that can be utilized to perform drilling or servicing operations, and the length of the tubing that can be used.

Due to improvements in the materials used for making the coiled-tubings and improvements in the tubing-handling equipment, coiled-tubings of varying sizes are now commonly used to perform many functions previously performed by drill pipes or jointed-tubulars. Due to the low cost of operating coiled-tubings, the flexibility of its use and the continued increase in the drilling of complex wellbores, such as multi-lateral wellbores, highly deviated wellbores and the more recent development of contoured wellbores, the use of coiled-tubings has been steadily increasing.

However, the injectors and the equipment for handling tubings from reels to injectors are still typically designed to run a specific tubing size. Most of the operations of the prior art injectors, tubing reels and wellhead equipment are manually performed by operators who respond to visual gauges to operate a variety of control valves that direct hydraulic power to different elements of such injectors, tubing reels and the wellhead equipment. The prior art injectors are not designed to allow for the passage of relatively large diameter bottom hole assemblies therethrough. Thus, in order to perform a drilling or workover operation with a relatively large diameter bottom hole assembly attached to the lower end of a relatively small outer diameter tubing, the bottom-hole assembly is either attached below the injector prior to placing the injector on the subsea wellhead or it is attached below the tubing after the tubing has passed through the injector. Such a process is relatively cumbersome and can be unsafe.

For land operations, the injector head is typically placed on the wellhead equipment. To attach a bottomhole assembly such as a drilling assembly, the injector head is removed from the wellhead equipment to insert the bottomhole assembly into the wellhead equipment. Additionally, systems having vertically-movable injector head and gooseneck, which allow the operator to connect and disconnect the bottomhole assembly to the tubing on a working platform have also been used.

For land operations, the prior art tubing injection systems still require moving the injector head from its operating position whenever a relatively larger diameter bottomhole assembly is to be inserted into a wellbore through the wellhead equipment. These systems also do not provide an injector head that allows the passage of both tubings and bottomhole assemblies of a variety of sizes to pass through the injector head when the bottomhole assembly is already connected to the tubing.

An additional drawback of the prior art injector heads is that they bite into the coiled tubing and frequently induce into the coiled tubing excessive stress resulting in reduced tubing life or damaged tubing. In some cases, the damaged tubing requires the operators to cease the operations and replace the tubing, which can cost several thousand dollars of down time.

It is, therefore, desirable to have an injector head that allows the passage of a wide range of bottomhole assemblies through the injector head and insert and remove coiled tubings of various sizes into and from the wellbore without the necessity of removing the injector head. It is further desirable to have an injector head which can securely grip the tubings without inducing undue radial stress into the tubings or damaging the tubings.

In the prior art systems, the tubing is typically unwound from a reel and passed over a gooseneck, which is a rigid structure of a relatively short radius. Such goosenecks impart great stress onto the tubing when the tubing is passed from a tubing reel into the injector head. Also, the prior art systems utilize manual methods for controlling various operations of the tubing injection systems. Such manual methods are imprecise, can induce excessive stress in the tubing and are labor-intensive.

For offshore operations, floating vessels, such as ships, semi-submersible platforms, and fixed offshore platforms, such as jack-up rigs, are utilized for drilling, completing and servicing subsea wellbores and for performing workover and other post-drilling services. Most of the coiled-tubing injection systems are designed for use with land rigs. Relatively little progress has been made in developing coiled-tubing injection systems for subsea applications, especially from floating vessels or rigs. Coiled-tubing operations from floating rigs pose unique problems because of the constant motion of the vessel. Additionally, injector heads are not permanently installed on subsea wellhead because prior art injectors require attaching the bottom hole assemblies, such as drilling assemblies, typically having substantially greater outside diameters compared to the tubing, after the tubing has passed through the injector head. Additionally, prior art systems do not provide methods for transporting a bottomhole assembly attached to a tubing end between the wellhead and the vessel. Prior art systems also do not provide underwater tubing injection systems that are automatically operated from the surface. Due to the corrosive nature of sea water, electrical sensors are typically not used in connection with under-water injection heads. Also, prior art underwater injector systems are not efficient, do not allow for the automatic control of the injectors and typically require attaching the bottom hole assembly below the underwater injector prior to the placement of the injector on the wellhead.

U.S. Pat. No. 5,002,130, issued to Laky, discloses an injector placed underwater on the wellhead for injecting a tubing into the wellbore. To place the injector on the wellhead, the coiled-tubing is securely held into the injector. The injector is then lowered from the offshore platform into the sea by the coiled-tubing until it reaches the wellhead. The weight of the injector is used to lower it to the wellhead. To keep the injector from coming in contact with the sea water, the injector is encased in an enclosure. Water in the enclosure is displaced by a gas. Gas injection devices are provided for continuously injecting the gas into the enclosure to replace any gas that may leak during operations. Such a system requires gas injection equipment and other control equipment for ensuring continued supply of gas into the enclosure during the entire length of the operation being performed, which can be expensive and requires installing additional equipment underwater, such as the gas injection devices. The same results can be obtained by sealing selected elements of the injector, such as the bearings, drive mechanisms and motors, as provided by the present invention.

In addition to the above-noted deficiencies of the prior art systems, operations of the injector head and the wellhead equipment, such as the blowout preventor, are generally manually controlled by several operators. These operators adjust a variety of hydraulic control valves to adjust various operating parameters, such as the gripping pressure applied by the injector head on the tubing, the injector head speed, the back-tension on the tubing at the reel, and the operation of the blow-out-preventor equipment (BOP). Some systems require several operators who must be stationed at different locations at the rig to control the various operations of the injector head, reel and the wellhead equipment. Such manually controlled operations are imprecise, labor intensive, relatively inefficient and detrimental to the long life of the equipment, especially the coiled tubing.

It is, therefore, highly desirable to have a tubing injection system wherein certain operating parameters relating to the various equipment, such as the injector head, tubing reel and the wellhead equipment, are remotely and automatically controlled to provide a more efficient and safer rig operations. It is further desirable to provide a safe working area away from the injector head for the operator to connect and disconnect the bottomhole equipment to the tubing and to pass such equipment through the injector head without moving the injector head or the gooseneck.

It is also highly desirable to have a tubing handling system for subsea use that includes a permanently installed (for the duration of the work to be performed) injector at the subsea wellhead that can be opened to allow the passage of bottomhole assemblies therethrough and move the tubing through the wellbore. It is further desirable to remotely control the operation of such subsea injector to provide a more efficient and safe operation, including automatically adjusting the gripping force on the tubing to a desired value and shutting down the injection system and/or activating appropriate alarms if an unsafe condition, such a free falling tubing, is detected.

The present invention addresses the above-noted deficiencies of prior art land and subsea tubing handling systems and provides tubing injection systems, wherein a novel injector placed on the subsea wellhead or at the surface allows for the passage of relatively large diameter bottomhole assemblies therethrough. The tubing injection systems automatically control the operation of the injector, whether installed at the surface or underwater, and other elements of the tubing injection system. The subsea system further includes a secondary surface injector for transporting the bottomhole assemblies attached to the tubing from the vessel to the subsea injector.

SUMMARY OF THE INVENTION

In one embodiment, the present invention provides a rig which includes an electrically controllable injection system from a remote location. The injection system contains at least two opposing injection blocks which are movable relative to each other. Each such injection block contains a plurality of gripping members. Each gripping member is designed to accommodate removable Y-blocks that are designed for specific tubing size. The injector head is placed on a platform above the wellhead equipment. A plurality of force exerting members (usually referred to as the "RAMS") are coupled to the injector head for adjusting the width of the opening between the injection blocks and for providing a predetermined gripping force to the holding blocks. The RAMs are preferably hydraulically operated. A tubing guidance system is positioned above the injector head for directing a tubing into the injector head opening in a substantially vertical direction. The rig system contains a variety of sensors for determining values of various operating parameters. The system contains sensors for determining the radial force on the tubing exerted by the injector head, tubing speed, injector head speed, weight on bit ("WOB") during the drilling operations, bulk weight of the drill string, compression of the tubing guidance member during operations and the back tension on the tubing reel.

With respect to the operation of the injector head, during normal operation when the tubing is inserted into the wellbore, the control unit continually maintains the tubing speed, tension on chains in the injector head and radial pressure on the tubing within predetermined limits provided to the control unit. Additionally, the control unit maintains the back tension on the reel and the position of the tubing guidance system within their respective predetermined limits. The control unit also controls the operation of the wellhead equipment. During removal of the tubing from the wellbore, the control unit operates the reel and the injector head to remove the tubing from the wellbore. Thus, in one mode of operation, the system of the invention automatically performs the tubing injection or removal operations for the specified tubing according to programmed instruction.

The rig system of the present invention requires substantially less manpower to operate in contrast to comparable conventional rigs. The bottomhole assembly is safely connected from the tubing at a working platform prior to inserting the bottomhole assembly into the injector head and is then disconnected after the bottomhole assembly has been safely removed from the wellbore to the working platform above the injector head. This system does not require removing or moving either the tubing guidance system or the injector head as required by the prior art systems. The injector head is fixed above the wellhead equipment, which is safer compared to the system which require moving the injector head. Substantially all of the operation is performed from the control unit which is conveniently located at a safe distance from the rig frame, thus providing a relatively safer working environment. The operations are automated, thereby requiring substantially fewer persons to operate the rig system.

The present invention also provides a tubing injection system for moving a tubing through subsea wellbores. The system includes an electrically-controllable underwater injector near the seabed. The underwater injector operates in the same manner as described above with reference to the land system. A surface injector on the vessel moves the bottomhole assembly attached to the tubing end from the vessel to the subsea injector. A riser placed between the vessel and the underwater injector guides the tubing into the subsea injector. After the tubing has passed through the underwater injector, the secondary surface injector may be made inoperable. A relatively small third injector (also referred herein as the "reel injector") may be utilized to move the tubing from a reel to the secondary surface injector and to provide desired tubing tension between the reel and the third injector.

A tubing guidance system at the vessel platform may also be utilized to guide the tubing from the reel through the secondary injector in substantially vertical direction. The underwater injector is preferably electrically controlled and hydraulically operated. Hydraulic power source is placed on the vessel, while electrically-controlled fluid valves associated with the underwater injector are preferably placed underwater near the underwater injector. A variety of sensors associated with the tubing injection system provide information about certain operating parameters relating to the tubing injection system. A control unit at the surface controls the operation of the tubing injection system, including the tubing gripping force, tubing speed, injector speed, compression of the tubing guidance member and the back tension on the tubing reel. The drives, bearings and motors in the underwater injector are selectively sealed while the chain mechanism is left exposed to the sea water.

This invention also provides a novel modular tubing source (reel) and a novel reel injector. The reel injector can be tilted about a vertical axis and contains a plurality of force measuring sensors, which are used to determine the arch of the tubing between the reel injector and the injector to which it feed the tubing (main surface injector). The tilt angle of the reel injector and the speed of the tubing leaving the reel injector are adjusted to maintain a desired arch of the tubing between the reel injector and the main surface injector. For offshore operations, the reel may be placed on one vessel and the reel injector on the offshore platform. In this case, a portion of the tubing between the reel and the reel injector passes through the water.

During operation, the control unit continually maintains the tubing speed, tension on the injector chains and radial pressure on the tubing within predetermined limits provided to the control unit. Additionally, the control unit maintains the back tension on the reel. The control unit also may control the operation of the wellhead equipment. During removal of the tubing from the wellbore, the control unit operates the reel and the injector in the reverse direction to remove the tubing and any bottom hole assembly attached to its bottom end from the wellbore. Substantially all of the operation is performed from the control unit which is conveniently located at the surface. The operations are automated, thereby requiring substantially fewer persons to operate the system compared to the prior art systems.

The present invention provides a method for moving a tubing through a subsea wellbore. The method comprises the steps: (a) placing a subsea injector adjacent the seabed; (b) placing a surface injector at the surface; (c) providing a riser between the subsea and the surface injectors for guiding the tubing to the first injector; (d) moving the tubing from a source to the subsea injector through the riser by the surface injector; and (e) moving the tubing through the wellbore with the subsea injector.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DETAILED DESCRIPTION OF PREFERRED EMBODIMENTS

Figure 1:
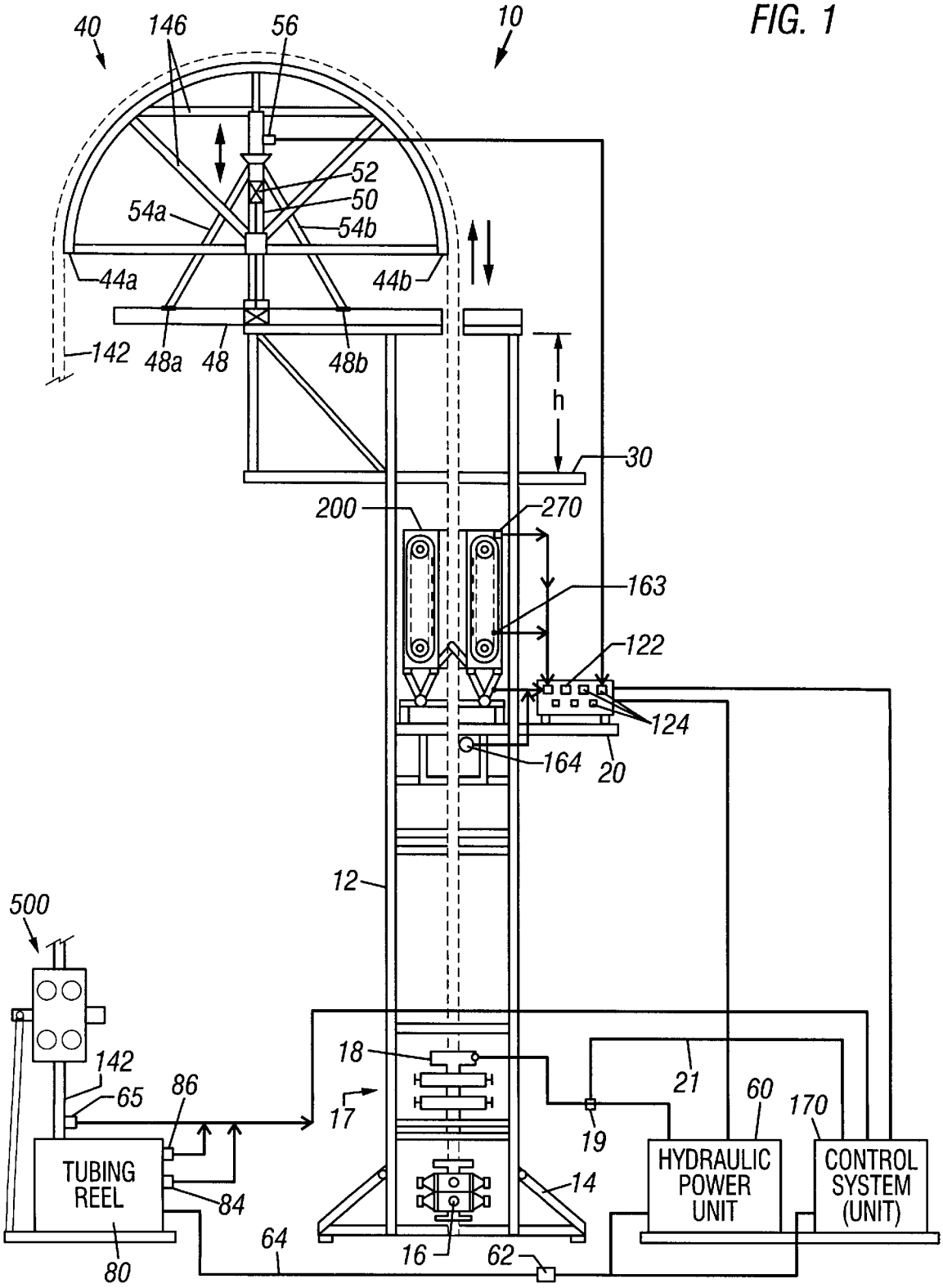
FIG. 1 shows a schematic elevational view of a land drilling rig utilizing the tubing injection system according to the present invention.
Figure 3:
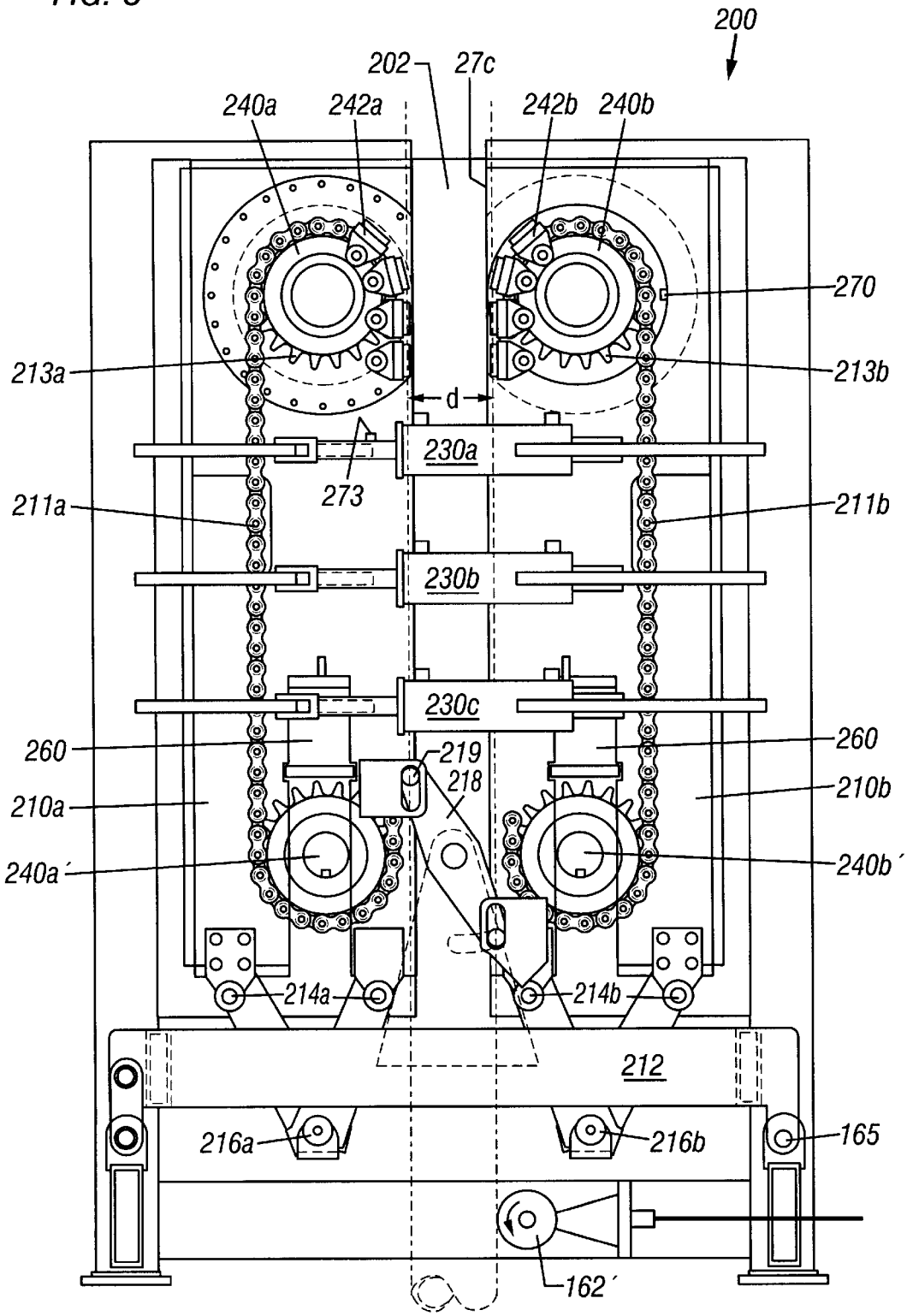
FIG. 3 shows a schematic elevational view of an injector according to the present invention for use with the subsea and land drilling systems shown in FIGS. 1 and 2.

FIG. 1 shows a schematic elevational view of a land rig 10 utilizing a tubing handling system according to the present invention. The rig 10 includes a substantially vertical frame 12 placed on a base or platform 14. A suitable wellhead equipment 17 containing a wellhead stack 16 and a blowout preventor stack 18 are placed as desired over the well casing (not shown) in the wellbore. A first platform or injector platform 20 is provided at a suitable height above the wellhead equipment 17. An injector, generally denoted herein by numeral 200 and described in more detail later in reference to FIG. 3, is fixedly attached to the injector platform 20 directly above the wellhead equipment 17. A control panel 122 for controlling the operation of the injector head is preferably placed on the injector platform 20 near the injector 200. The control panel 122 contains a number of electrically-operated control valves 124 for controlling the various hydraulically-operated elements of the injector 200. The control valves 124 control the flow of a pressurized fluid from a common hydraulic power system or unit 60 to the various hydraulically operated devices in the system 10, as described in more detail below in reference to FIG. 3. An electrical control system or control unit 170, preferably placed at a remote location, controls the operation of the injector 200 and other elements of the rig 10 according to programmed instructions or models provided to the control unit 170. The detailed description of the injector 200 and the operation of the rig 10 are described below.

Still referring to FIG. 1, the rig 10 further contains a working platform 30 that is attached to the frame 12 above the injector 200. Tubing 142 to be used for performing the drilling, workover or other desired operations is coiled on a tubing reel 80. The reel 80 is preferably hydraulically operated and is controlled by the control unit 170. The control unit 170 controls a fluid control valve 62 placed in a fluid line 64 coupled between the reel 80 and the hydraulic power unit 60. A speed sensor 65, preferably a wheel-type sensor known in the art, is operatively coupled to the tubing near the reel 80. The output of the sensor 65 is passed to the control unit 170, which determines the speed of the tubing in either direction. A sensor 84 is coupled to the reel for providing the reel rotational speed. A tension sensor 86 is coupled to the reel 80 for determining the back tension on the tubing 142.

The tubing 142 from the reel 80 passes over a tubing guidance system 40, which guides the tubing 142 from the reel 80 into the injector 200. The tubing guidance system 40 is attached to the frame 12 above the working platform 30 at a height "h" which is sufficient to enable an operator to connect and disconnect the required downhole equipment to the tubing 142 prior to inserting it into the injector 200. The tubing guidance system 40 preferably contains a 180° guide arch 44 having a relatively large radius. A radius of about fifteen (15) feet has been determined to be suitable for coiled tubing having outside diameter between one (1) inch and three and one half (3.5) inches. A front end 44*a* of the guide arch 44 is preferably positioned directly above the reel 80 on which the tubing 142 is wound and the tail end 44*b* is positioned above an opening 202 of the injector 200 so that the tubing 142 will enter vertically into an injector opening 201. The guide arch 44 is supported by a rigid arch frame 46, which is placed on a horizontal support member 48 by a flexible connection system 50. The flexible connection system 50 contains a piston 52 that is coupled at one end to the guide arch 44 and to the member 48 at the other end. Members 54*a* and 54*b* are fixedly connected to the piston 52 and pivotly connected to the horizontal member 48 at pivot points 48*a* and 48*b*, respectively. During operations, as the weight or tension on the guide arch 44 varies, the piston 52 enables the guide system 40 to move vertically. The large radius and the piston 52 make the guide system 40 resilient, thereby avoiding excessive stress on the tubing 142. This system has been found to improve the life of the coiled tubing compared to the fixed gooseneck systems commonly used in the oil industry. A position sensor 56 is coupled to the piston 52 to determine the position of the guide arch 44 relative to its original or non-operating position. During operations the control unit 170 continually determines the position of the guide arch 44 from the sensor 56. The control unit 170 is programmed to activate an alarm and/or shut down the operation if the guide arch 44 has moved downward beyond a predetermined position. The position of the guide arch 44 correlates to the stress on the guide arch 44.

In an alternative embodiment, a reel injector 500 (shown in dotted lines and more fully described later with reference to FIGS. 5A–5D) may be deployed near the tubing reel 80 to move the tubing 142 from the reel 80 to the main injector 200. As described later, the reel injector 500 can maintain a desired arch of the tubing 80 that enables eliminating the use of the tubing guidance system 40 or any other type of gooseneck during normal operations, which reduces the stress on the tubing 80.

All of the hydraulically operable elements of the wellhead equipment 17 are coupled to the hydraulic power unit 60, including the blowout preventor stack 18. For each such hydraulically operated element, an electrically operable control valve, such as valve 19 or 124, is placed in an associated line, such as line 21 connected between the element and the hydraulic power unit 60. Each such control valve is operatively coupled to the control unit 170, which controls the operation of the control valve 19 or 124 according to programmed instructions. In addition, the control unit 170 may be coupled to a variety of other sensors (not shown), such as pressure and temperature sensors for determining the pressure and temperature downhole and at the wellhead equipment. The control unit 170 is programmed to operate such elements in a manner that will close the wellhead equipment 17 when an unsafe condition is detected by the control unit 170.

Figure 2:
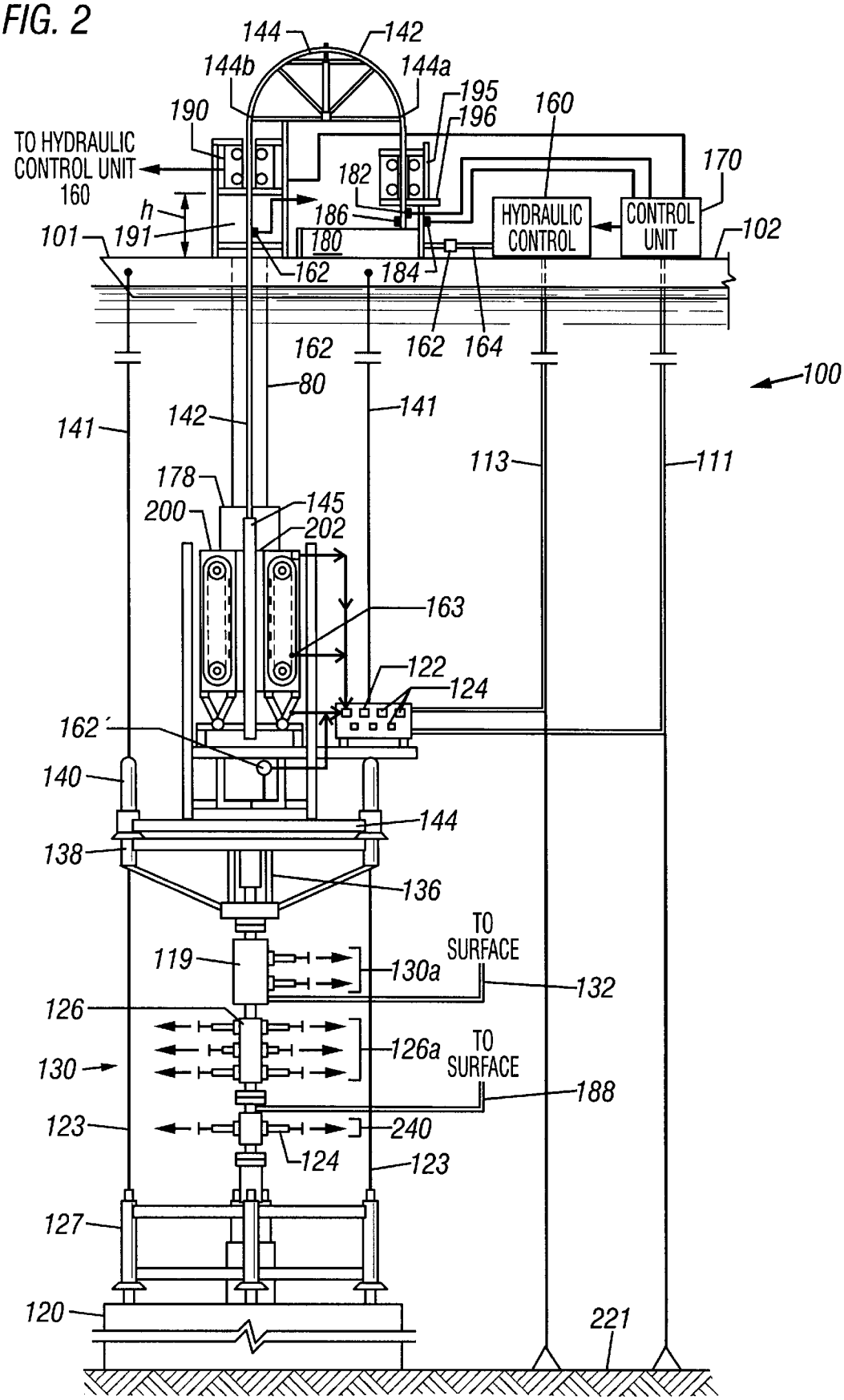
FIG. 2 shows a schematic elevational view of a tubing handling system for use in moving tubing through a subsea wellbore according to a preferred embodiment of the present invention.

FIG. 2 shows a schematic elevational view of a tubing injection system 100 that moves tubing 142 from a reel 180 at a floating rig 101 (such as a ship or a semi-submersible rig, herein referred to as the "vessel") to a permanently installed injector 200 at a subsea wellhead 119 and through a subsea wellbore (not shown) according to the present invention. A template 120 on the sea bed 121 supports a frame 127 that in turn supports the wellhead equipment (described below) and connects tension lines 123 to the vessel 101. FIG. 2 shows typical wellhead equipment used during the drilling of offshore wellbores. The wellhead equipment includes a control valve 124 that allows the drilling fluid to circulate to the surface via a fluid line 128 and a blow-out-preventor stack 126 having a plurality of control valves 126*a*. A lubricator 130 with its associated flow control valves 130*a* is shown placed over the blow-out-preventor stack 126. The flow control valves 130*a* associated with the lubricator 130 are utilized to control the discharge of any fluid from the lubricator 130 to the surface via a fluid flow line 132. A stuffing box 136, placed over the lubricator 130, provides a seal around the tubing 142 when it passes therethrough.

A first frame 138 is supported above the stuffing box 136 and a second frame 140, having a substantially flat platform 144, is supported over the first frame 138. The two frames 138 and 140 have suitable openings above the stuffing box 136, sufficient to allow passage of a desired sized bottom-hole assembly (not shown) to the stuffing box 136. Tension lines 123 connect the frames 127 and 138, while tension lines 141 are used to position the second platform 140 over the first platform 138. The tension lines 141 are moored to the vessel 101.

An injector, such as the injector 200 described earlier, is permanently (i.e. for the duration of the work to be performed) placed on the platform 144 above the wellhead equipment. A stripper 178 may be placed over the injector 200 to cut the tubing 142, if required during operations. A control unit 170, such as described earlier with respect to FIG. 1, placed on the vessel 101, controls the operation of the tubing injection system 100, including the operation of the injector 200, the wellhead and various other elements associated with the tubing injection system 100. The control unit 170 preferably includes a computer, associated memory, recorder, display unit and other peripheral devices (not shown). The computer computes the values of the various operating parameters from input or data received from the various sensors in the tubing injector system 100 and carries out data manipulation in response to programmed instructions provided to the control unit 170.

A hydraulic power unit 160 placed on the vessel platform 102 provides the required pressurized fluid to the various hydraulically-operated devices in the tubing injection system 100. A valve control unit or panel 122 having a plurality of electrically-operated fluid control valves 124 is preferable placed on or near the injector 200. The valve control panel 122 may, however, be placed at any other suitable location, including on the vessel platform 102. Individual control valves 124 control the flow of the pressurized fluid from the hydraulic power unit 160 to the various devices in the injector 200, thereby controlling the operation of such associated devices. Electrical power conductors to the panel 122 and other subsea devices and two-way data communication links between the subsea devices and the control unit 170 are placed in a suitable conduit 111. Pressurized fluid from the hydraulic control unit 160 to the control panel 122 is provided via a conduit 113. The operation of the system 100 is described below.

Tubing 142 is coiled on the reel 180 placed on the vessel platform 102.

The reel 180 is preferably hydraulically-operated and controlled by the control unit 170. To control the operation of the reel 180, the control unit 170 operates a fluid control valve 162 placed in a fluid line 164 coupled between the reel 180 and the hydraulic power unit 160. A sensor 182, preferably a wheel-type sensor, is operatively coupled to the tubing near the reel 180. The output of the sensor 182 passes to the control unit 170, which determines the speed of the tubing 142 in either direction. A sensor 184, coupled to the reel 180, provides the rotational speed of the reel 180. A tension sensor 186 is coupled to the tubing 142 for determining the back tension on the tubing 142.

Figure 5B:
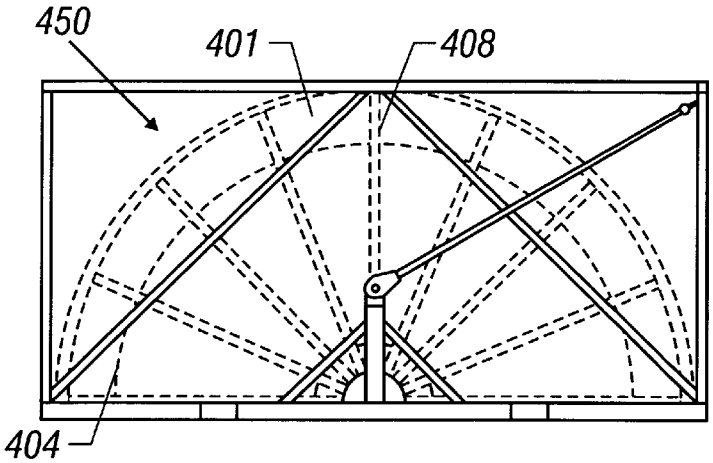
FIGS. 5A–5D show a novel modular tubing reel and a novel injector for moving the tubing between the reel and another injector that avoids the use of a tubing guidance systems.
Figure 5A:
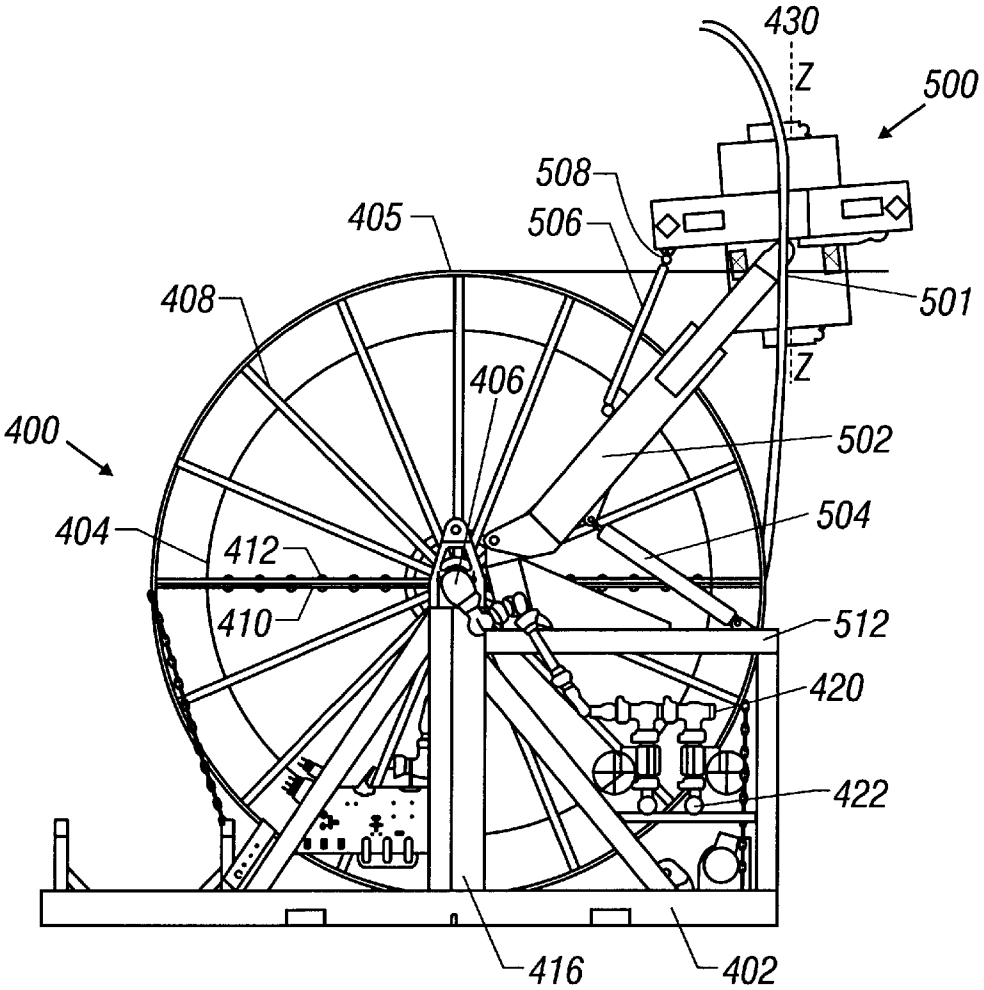

In the preferred embodiment of the present invention, a relatively small injector 195 is positioned above the reel 180 for moving the tubing 142 from the reel 180 to a secondary surface injector 190 and for providing desired tubing tension between the injector 195 and the reel 180. The injector 195 is located at a suitable distance above the reel 180, such as by mounting it on a support member 196 attached above the reel 180. An alternative manner of mounting the injector head is shown in FIG. 5A. The injector 195 moves the reel between the injectors 190 and 195 and provides and controls the tubing or line tension between the reel 180 and the injector 190. Although the use of the injector head 195 is described with reference to the offshore rig system 100, it will be obvious that such an injector may also be utilized in land tubing injection systems, such as shown in FIG. 1.

The injector 190 is preferably placed at a height "$h_1$" above the vessel platform 102 so as to provide adequate working space below the injector 190 to install borehole assemblies to an end of the tubing 142 received below the injector 190. If a movable injector is utilized as the injector 190, the height "$h_1$" can be adjusted to facilitate assembly and installation of the bottomhole assembly to the tubing. For the purpose of this invention any suitable injector may be used as injector 190 or injector 195.

In addition to or as an alternative to using the injector head 195, a tubing guide or gooseneck 144 may be utilized to guide the tubing 142 from the reel 180 to the secondary surface injector 190. Any gooseneck may be utilized for the purpose of this invention. The tubing guide 144 preferably has a 180° guide arch which enables the tubing to move from the reel 180 substantially vertically toward the vessel platform 102. The front end 144*a* of the gooseneck 144 is preferably positioned directly above the reel 180 and the tail end 144*b* is positioned above an opening 191 of the surface secondary injector 190 in a manner that will ensure that the tubing 142 will enter the secondary surface injector opening 191 vertically.

A riser 80, which may be a rigid-type riser or flexible-type riser, placed between the platform 102 and the injector 200, guides the bottomhole assembly 145 and the tubing 142 into a through opening 201 in the injector 200. The primary purpose of the injector 195 is to provide desired tension to the tubing 142 while the primary purpose of the surface injector 190 is to move the tubing 142 between the reel 180 on the vessel 101 and the injector 200. Therefore, once the bottom hole assembly 145 has passed through the opening 201 of the subsea injector 200, the surface injector 190 may be fully opened so that the tubing 142 freely passes therethrough. For a majority of the applications, the secondary surface injector 190 need only be made strong enough so that it can move the tubing 142 between the reel 180 and the subsea injector 200. However, for certain applications, such as relatively large diameter tubings, the surface injector 190 may be utilized to maintain a desired line pull (tension) between the reel 180 and the injectors 190 and 200. The secondary surface injector 190 may also be utilized to augment the subsea injector 200 in case of emergency, such as in the event the tubing 142 starts to free fall into the wellbore.

Still referring to FIG. 2, all of the hydraulically-operable elements, including each of the injectors 190, 195 and 200, control valves of the blowout preventor 26 and those of the lubricator 30, receive pressurized fluid from the hydraulic power unit 160 via their associated fluid lines. Typically, for each such hydraulically-operated element, an electrically-operated control valve, such as valve 124, is placed in its associated line (not shown), which is connected between the element and the hydraulic power unit 160. Each such control valve is operatively coupled to the control unit 170, which controls its operation according to programmed instructions. In addition, the control unit 170 is coupled to a variety of other sensors, such as pressure and temperature sensors for determining the pressure and temperature at the wellhead. The control unit 170 is programmed to operate such elements in a manner that will close the wellhead equipment when an unsafe condition is detected by the control unit 170.

A typical procedure to move the bottomhole assembly 145 attached to the end of the tubing 142 from the vessel 101 into the wellbore is as follows. The subsea injector 200 is permanently (for the duration of the task to be performed) mounted on the subsea wellhead in any suitable manner. An end of the tubing 142 is moved through the surface injector 190 into the work area 191. The bottomhole assembly 145 is attached to the end of the tubing 142. The pressure between the stuffing box 136 and the lubricator 130 is equalized. This may be done by closing the lower valve 130*a* of the lubricator 130. The stuffing box 136 is opened and the subsea injector 200 is opened to its fully open position. The reel 180, injectors 190 and 195 (if installed) are then operated to move the tubing 142 into the riser 80. The tubing 142 is moved by the injector 190 while the small injector 195 provides a desired line pull between the injector head 195 and the reel 180. The riser 80 guides the bottomhole assembly 145 from the vessel 101 through the opening 201 of the injector 200 and into the stuffing box 136.

After the bottomhole assembly 145 has passed into the stuffing box 136, the injector 200 is operated so that the gripping members of the chain mechanism (described later) securely hold the tubing 142. The stuffing box 136 is closed around the tubing 142. The lubricator 130 is pressure tested using sea water provided by a control line 132 from the surface or via the tubing 142 and the bottomhole assembly 145. The pressure between the lubricator 130 and the wellbore is then equalized by using any known method in the art. The wellhead valves 126*a* are then opened to allow the bottomhole assembly to pass therethrough and into the wellbore. The subsea injector 200 is operated at a desired speed to move the bottomhole assembly 145 into the wellbore. During operation, the wellbore fluid is circulated through the tubing 142, the bottomhole assembly 145, and a return line 128 at the wellhead to the surface. The wellbore fluid is not circulated through the lubricator 130. The lubricator 130 is filled with the sea water to prevent collapse of the lubricator 130.

The above procedure is reversed to retrieve the bottomhole assembly 145 to the vessel 101 It will be appreciated that in the present system, the subsea injector 200 is installed only once for the entire length of the operation. The bottomhole assembly is moved into and out of the wellbore without removing the injector 200. The above procedure allows for attaching the bottomhole assembly to the tubing 142 at the vessel 101 and passing it through the subsea injector 200 and then moving the bottomhole assembly and the tubing 142 through the wellbore. This procedure is relatively simple and is safer compared to the prior art methods. In the prior art methods, the bottomhole assembly 145 is attached to the tubing below the injector, to be deployed underwater prior to the deployment. Also, the injector is deployed underwater with the coiled-tubing securely holding the injector. To retrieve the bottomhole assembly to the vessel, the underwater injector is moved to the vessel.

The function and operation of the injector 200 will now be described while referring to FIGS. 3, 4A, and 4B. FIG. 3 shows a schematic elevational view of an embodiment of the injector 200 according to the present invention. The injector 200 contains two vertically placed opposing blocks 210*a* and 210*b* that are movable with respect to each other in a substantially horizontal direction so as to provide a selective opening 272 of width "d" therebetween. The lower end of the block 210*a* is placed on a horizontal support member 212 supported by upper rollers 214*a* and a lower roller 216*a*. Similarly, the lower end of the block 210*b* is placed on a horizontal support member 212 supported by upper rollers 214*b* and lower roller 216*b*. The blocks 210*a* and 210*b* are pivotly connected to each other at a pivot point 219 by pivot members 218 in a manner that enables the blocks to move horizontally, thereby creating a desired opening of width "d" between such blocks. A plurality of hydraulically-operated members (RAM) 230*a–c* are attached to the blocks 210*a–b* for adjusting the width "d" of the opening 272 to a desired amount. The RAMS 230*a–c* are operatively coupled via a control valve 124 placed in the control panel 122 to the hydraulic power unit 160. The control unit 170 controls the RAM action. The RAMS 230*a–c* are all operated in unison so as to exert substantially uniform force on the blocks 210*a* and 210*b*.

Injector block 210*a* preferably contains an upper wheel 240*a* and a lower wheel 240*a*', which are rotated by a chain 211*a* connected to teeth 213*a* and 213*b* of the wheels 240*a* and 240*b* respectively. The upper wheel 240*a* contains a plurality of tubing holding blocks 242*a* attached around the circumference of the upper wheel 240*a*. Similarly, injector block 210*b* contains an upper wheel 240*b* and a lower wheel 240*b*', which are rotated by a chain 211*b* connected to the teeth of such wheels. The upper wheel 240*b* contains a plurality of tubing holding blocks 242*b* attached around the circumference of the upper wheel 240*b*. The wheels 240*a* and 240*b* are rotated in unison by a suitable variable speed motor (not shown) whose operation is controlled by the control unit 170. Each block 242*a* and 242*b* is adapted to receive a Y-block therein, which is designed for holding or gripping a specific tubing size or a narrow range of tubing sizes. Additionally, a separate vertically operating RAM 260 is connected to each of the lower wheels for maintaining a desired tension on their associated chains. The RAMS 260 are preferably hydraulically-operated and electrically-controlled by the control unit 170.

Still referring to FIG. 3, for underwater use, members 240*a* and 240*b*, motors (not shown) for operating the chain drives, RAMs 230*a–*230*c*, panel 122, and any other electro-hydraulic interface and bearings of the injector 200 are selectively sealed, leaving the chain and the blocks 242 exposed to the water. Sealing selected items of the subsea injector 200 prevents such elements from rusting and avoids either completely sealing the subsea injector 200 or using gas to expel water from around the subsea injector 200 as taught by prior art methods, which can be very expensive.

Figure 4A:
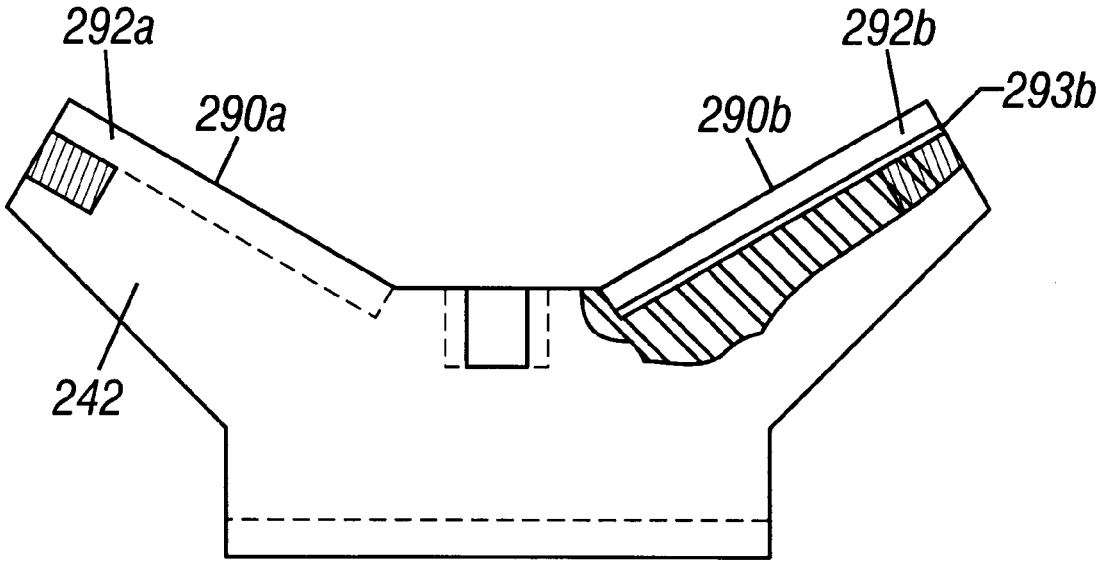
FIG. 4A shows a side view of a block having a resilient member for use in the injector head of FIG. 3.
Figure 4B:
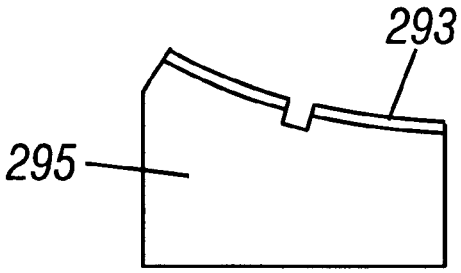
FIG. 4B shows a side view of a gripping member for use in the block of FIG. 4A.

FIG. 4A shows a side view of an injection tubing holding block 242, such as blocks 242*a–b* shown in FIG. 3. FIG. 4B shows a side view of a holding member 295 for use in the block 242. The block 242 is "Y-shaped" having outer surfaces 290*a* and 290*b* which respectively have therein receptacles 292*a* and 292*b* for receiving therein the tubing holding member 295. Each surface of the Y-block 242 contains a resilient member, such as member 293*b* shown placed in the surface 292*b*. The outer surface of the holding member 295 may contain a rough surface or teeth for providing friction thereto for holding the tubing 142 (FIG. 2). A separate holding member 295 is placed in each of the outer surfaces of the Y-block 242 over the resilient member. The Y-blocks 242 are fixedly attached to the upper wheels 240*a–b* around their respective circumferences as previously described. During operations, the Y-blocks are urged against the tubing 142, which causes the holding members 295 to somewhat bite into the tubing 142 to provide sufficient gripping action. As the wheels 240*a–b* rotate, the Y-blocks 242 grip the tubing 142 and move it in the direction of rotation of the wheels 240*a–b*. If the tubing has irregular surfaces or relatively small joints, the resilient members provide sufficient flexibility to the holding members to adjust to the changing contour of the tubing without sacrificing the gripping action.

As shown in FIG. 3, the injector 200 preferably includes a number of sensors which are coupled to the control unit 170 (FIG. 2) for providing information about selected injector head operating parameter. The injector head 200 preferably contains a speed sensor 270 for determining the rotational speed of the injector 200, which correlates to the speed at which the injector head 200 should be moving the tubing 142 (FIG. 2). The control system 170 determines the actual tubing speed from the sensor 162 (FIGS. 1 and 2), which may be placed at any suitable place such as near the injector head as shown in FIG. 3. A sensor 273 is provided to determine the size "d" of the opening between the injector head Y-blocks 242. Additional sensors are provided to determine the chain tension and the radial pressure or force applied to the tubing 142 by the Y-blocks 242.

Now referring back to FIG. 1, the control unit 170 is coupled to the various sensors and control valves in the rig 10 and it controls the operation of the rig 10, including that of the injector head 200 and the blowout preventor 18 according to programmed instructions. Prior to operating the rig 10, an operator enters information into the control unit 170 about various elements of the system, such as the size of the tubing and limits of certain parameters, such as the maximum tubing speed, the maximum difference allowed between the actual tubing speed obtained from the sensor 162 and the tubing speed determined from the injector head speed sensor 270. The control unit 170 also continually determines the tension on the chains 211*a* and 211*b,* and the radial pressure on the tubing 142.

Still referring to FIG. 1, to operate the rig 10, an operator inputs to the control unit 170 the maximum outside dimension of the bottomhole assembly 145, the size of the tubing 142 to be utilized, the limits or ranges for the radial pressure that may be exerted on the tubing 142, the maximum difference between the actual tubing speed and the injector head speed and limits relating to other parameters to be controlled. An end of the tubing 142 is passed over the guide arch 44 and held in place above the working platform 30. An operator attaches the bottomhole assembly 145 of the desired downhole equipment to the tubing end. The RAMS 230*a–c* are then operated to provide an opening 202 in the injector head 200 that is sufficient to pass the bottomhole assembly therethrough. After inserting the bottomhole assembly into the wellhead equipment 17, the control unit 170 can automatically operate the injector 200 based on the programmed instruction for the parameters as input by the operator. In one mode, the system 10 may be operated wherein the control unit 170 inserts the tubing 142 at a predetermined speed and maintains the radial pressure on the tubing 142 within predetermined limits. If a slippage of the tubing 142 through the injector 200 is detected, such as when it is determined that the actual speed of the tubing 142 is greater than the speed of the injector 200, then the control unit 170 causes the RAMS 230*a–c* to exert additional pressure on the tubing to provide greater gripping force to the blocks 242*b*. If the slippage continues even after the gripping force has reached the maximum limit defined for the tubing 142 and the back tension on the tubing is within a desired range, the control unit 170 may be programmed to activate an alarm (not shown) and/or to shut down the operation until the problem is resolved.

Still referring to FIG. 1, with respect to the operation of the injector 200, during normal operation when the tubing is inserted into the wellbore, the control unit 170 continually maintains the tubing speed, tension on the chains 211*a–b* and radial pressure on the tubing 142 within predetermined limits provided to the control unit 170. Additionally, the control unit 170 maintains the back tension on the reel 180 and the position of the tubing guidance system 40 within their respective predetermined limits. The control unit 170 also controls the operation of the wellhead equipment 17. During removal of the tubing from the wellbore, the control unit 170 operates the reel 180 and the injector 200 to remove the tubing 142 from the wellbore. Thus, in one mode of operation, the system 10 of the invention automatically performs the tubing injection and removal operations for the specified tubing used according to programmed instruction.

The rig system 10 of the present invention requires substantially less manpower to operate in contrast to comparable conventional rigs. The bottomhole assembly is safely connected to the tubing 145 at a working platform 30 prior to inserting the bottomhole assembly into the injector head and disconnected after the bottomhole assembly has been safely removed from the wellbore to the working platform 30 above the injector head without requiring human intervention to move either the tubing guidance system 40 or the injector 200 as required in the prior art systems. The injector 200 is fixed above the wellhead equipment 18, which is safer compared to the systems which require moving the injector. Substantially all of the operation is performed from the control unit 170 which is conveniently located at a safe distance from the rig frame 12, thus providing a relatively safer working environment. The operations are automated, thereby requiring substantially fewer persons to operate the rig system.

Now referring to FIGS. 2 and 3, the tubing injection system 100 contains a number of sensors. Such sensors are coupled to the control unit 170 which determines information about selected parameters of the tubing injection system 100. The subsea injector 200 preferably contains a speed sensor 270 for determining the rotational speed of the injector, which correlates to the speed at which the injector 200 should be moving the tubing 142. The control unit 170 determines the actual tubing speed from the sensor 162 placed at the surface injector 190 or a sensor 162' placed at the subsea injector 200. A sensor 273 is provided to determine the size "d" of the opening between the injector Y-blocks 242*a–b*. Additional sensors are provided to determine the tension on the chains 211*a* and 211*b* and the radial pressure or force applied to the tubing 142 by the Y-blocks 242*a–b*.

As shown in FIG. 2, the control unit 170 is coupled to the various sensors and control valves in the system 100 for determining the values of the various operating parameters of the system 100 including parameters relating to the injectors 190, 195 and 200, the tension on the tubing 142 and the actual speed of the tubing 142. It also controls the operation of the system, including that of the injector 200 according to programmed instructions. Any connections between the control unit 170 and the subsea sensors may be made by electrical wires run inside a sea worthy cable or conduit 113.

Prior to operating the system 100, an operator provides the control unit 170 with information about various elements of the system 100, such as the sizes of the tubing 142 and the bottomhole assembly 145 and limits of certain parameters, such as the maximum tubing speed, the maximum difference permitted between the actual tubing speed obtained from the sensor 162 or 162' and the tubing speed determined from the injector speed sensor 270. Additionally, the maximum radial pressure that may be exerted on the tubing 142 and limits relating to other parameters to be controlled are also provided to the control unit 170. To pass the bottomhole assembly 145 through the injector opening 202, the control unit 170 operates the RAMS 230*a*–230*c* to provide an opening that is large enough to pass the bottomhole assembly 145 through the opening. After the bottomhole assembly 145 has passed through the lubricator 30, the control unit 170 may be set to automatically operate the injector 200 based on the programmed instruction. In one mode, the system 100 may be operated wherein the control unit 170 inserts the tubing 142 at a predetermined speed and maintains the radial pressure on the tubing 142 within predetermined limits. If a slippage of the tubing 142 through the subsea injector 200 is detected, i.e., when the actual speed of the tubing is greater than the speed of the injector, then the control unit 170 causes the RAMS to exert additional pressure on the tubing 142 to provide greater gripping force to the blocks 242*a–b*. If the slippage continues even after the gripping force has reached the maximum limit defined for the tubing 145 and the back tension on the tubing is within a desired range, the control unit 170 is programmed to activate an alarm and/or to shut down the operation until the problem is resolved.

Still referring to FIG. 2, with respect to the operation of the injector 200, during normal operation when the tubing 142 is inserted into the wellbore, the control unit 170 continually determines the tension on the chains 211*a* and 211*b* (FIG. 2), the radial pressure on the tubing., and the speed of the tubing 142, and operates the injector 200 so as to maintains the tubing speed, tension on the chains 211*a–b* and radial pressure on the tubing within predetermined limits provided to the control unit 170. The control unit 170 also controls the operation of the wellhead equipment 118. During removal of the tubing 142 from the wellbore, the control unit 170 operates the reel 180 and the injectors 190, 195 and 200 to remove the bottomhole assembly 145 and the tubing 142 from the wellbore.

Referring back to FIG. 2, it shows the use of an injector 195 for moving the tubing 142 between the reel 180 and the injector 190 which moves the tubing toward the wellbore. FIGS. 5A–5D show a novel modular tubing reel 400 and a novel injector head 500 for moving a tubing 430 between the reel 400 and another injector (such as injector 200 in land tubing injection system 10 shown in FIG. 1 and injector 190 in offshore tubing operation system 100 shown in FIG. 2) that avoids the use of a tubing guidance systems, such as systems 144 during normal operations.

Referring to FIG. 5A, the reel 400 disposed on a skid 402 contains a spool or drum 404 with an outer flange 405 at each of the drum 404. The drum 404 supports the tubing 430 and rotates about an axis defined by a center member or pin 406. The drum 404 connects to the center member by a plurality of radial spokes 408. The drum 404 which is typically between 20 and 40 feet in diameter is preferably modular, in that it may be disassembled into smaller components. In the preferred embodiment, the reel 400 is made by connecting two halves by a plurality of bolts 412 along a center line 410. The reel 400 can readily be disassembled into the halves 450 shown in FIG. 5B, which enables transporting smaller components to and from the well site. Modular construction is useful as it allows disassembling the reel into components that can be transported in standard containers, which are typically 40 feet long.

The reel 400 preferably includes cable conduit 420 that allows passing a cable (not shown) into the tubing 430. Cables, which may be multi-conductor cables, co-axial cables, fiber optic cables, etc. are utilized to supply power to downhole devices and to provide two-way data and signal communications between downhole and surfaced devices. Electrically-controlled hydraulic valves 422 are preferably utilized to deliver hydraulic power to move the cable.

Figure 5D:
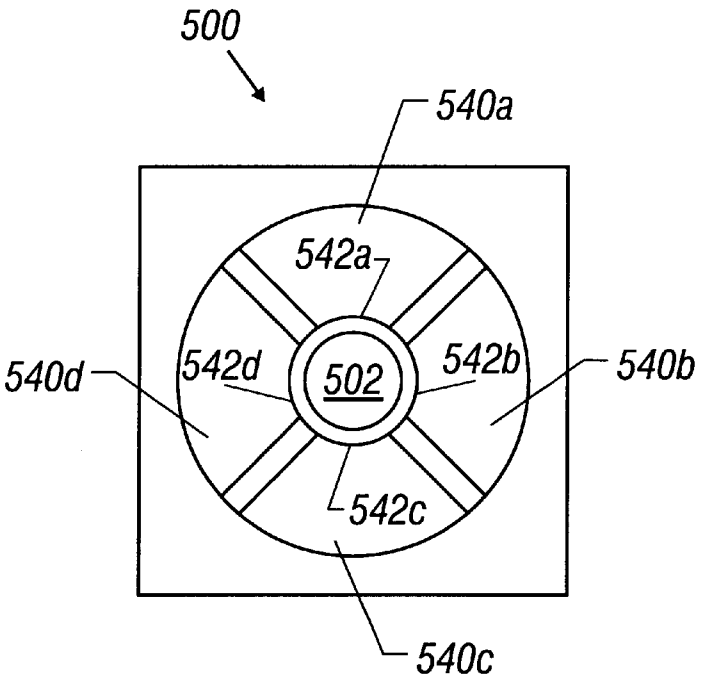
Figure 5C:
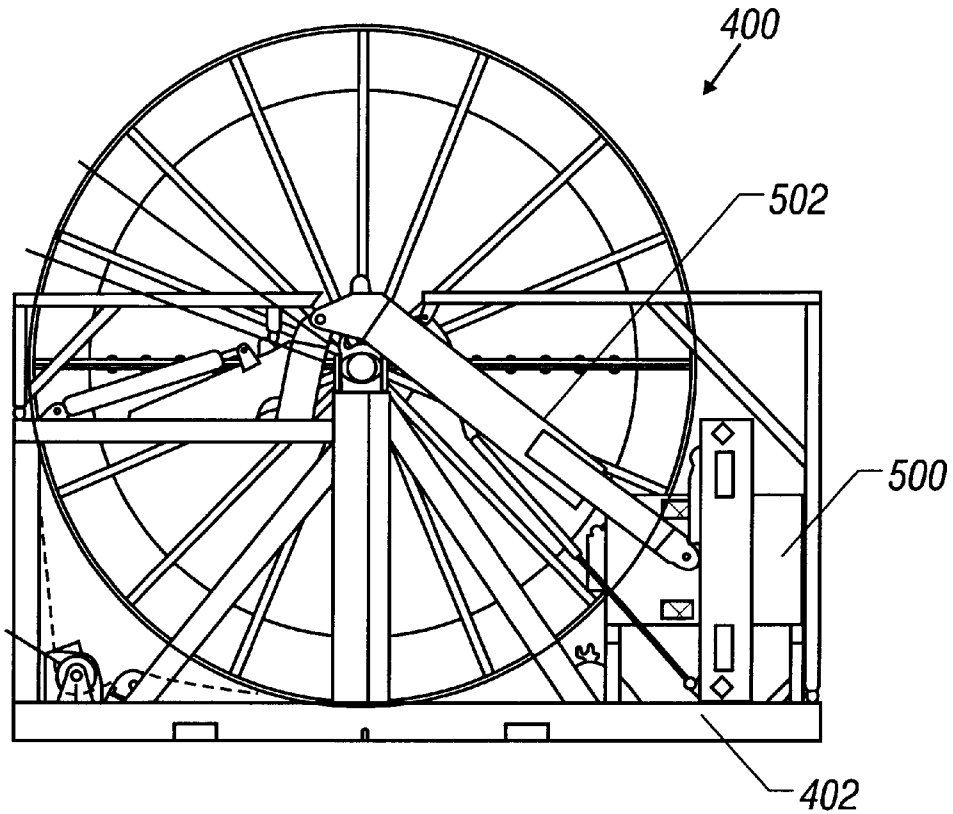

An injector head 500 is preferably mounted at an outer end 501 of a radially movable injector arm 502, which may be conveniently coupled to the reel support 416. The injector arm 502 extends a desired distance above and around the reel 400. A hydraulically operated telescopic arm 504 coupled between the injector arm 502 and an injector support frame 502 may be utilized to radially move and locate the arm 502 at any desired location around the reel 400. This mechanism allows positioning the injector 500 at any location around the reel, providing flexibility of operation for varying rig designs and well operating conditions. The injector 500 is normally lowered to rest on the skid 402 when it is not in use as shown in FIG. 5C. This makes it easier to transport the injector and is safer at the rig site during idle conditions. A second telescopic arm 506 pivotly connected to the injector arm 502 and a suitable support member 508 on the injector 500 moves the injector 500 about its pivot point 501 to provide the injector 500 a desired tilt about a vertical axis z—z, as explained below.

To install the tubing 502 at a rig site, the reel 400 is transported in two separate halves 401. The tubing 502, which may be several thousand feet long, is transported separately spooled on a reel of substantially smaller diameter that the reel 400. The injector 500 may be transported separately or attached to one half the reel 400. The two halves 401 are assembled at the rig site to form the reel 400. The injector 500 is then installed (if transported separately from the reel 400) on the reel 400 as shown in FIG. 5A. The tubing 502 is then spooled from the transporting reel (not shown) onto the working reel 400 with the injector 400.

The injector 500 has associated with it the sensors described in reference to FIG. 2, which may include a sensor for determining the tension on the tubing 502 and speed of the tubing leaving the injector 500. Additionally, the injector 500 include a sensor system that enables maintaining the arch of the tubing between the injector 500 and the injector to which the tubing 502 is fed, as more fully explained in reference to FIG. 6. FIG. 5D shows a schematic illustration of the top view of the injector 500 with a plurality of force or pressure responsive sensors 540*a*–540*d* for maintaining the arch of the tubing 502. The sensors 540*a*–540*d* each have an inner concave surface 542*a*–542*d* respectively. The sensors 540*a*–540*d* can be moved inward or outward to define the size of the opening 544. The sensors 540*a*–540*d* form a concentric ring-like structure, which is suitably disposed in the injector 500 or at a suitable location above the injector 500. The tubing 502 leaving the injector passes through the opening 544. The opening 544 is large enough to allow relatively free passage of the tubing 502 therethrough. The tubing 502 leaving the injector exerts pressure on one or more of the sensors 540*a*–540*d*. FIG. 5D shows the tubing exerting pressure against the sensor 540*a* as the tubing is in contact with its inner surface 542*a*. Each of the sensors 540*a*–540*d* provides a signal corresponding to the amount of the force exerted by the tubing 502 on such sensor. The desired force range for each of the sensor is determined based on the arch requirements, which in turn depend upon the tilt angle of the injector head 500 and the speed of the tubing 502. During operations, the tilt angle of the injector 500 and the speed of the tubing 502 through the injector 500 are controlled to maintain the desired arch.

Figure 6:
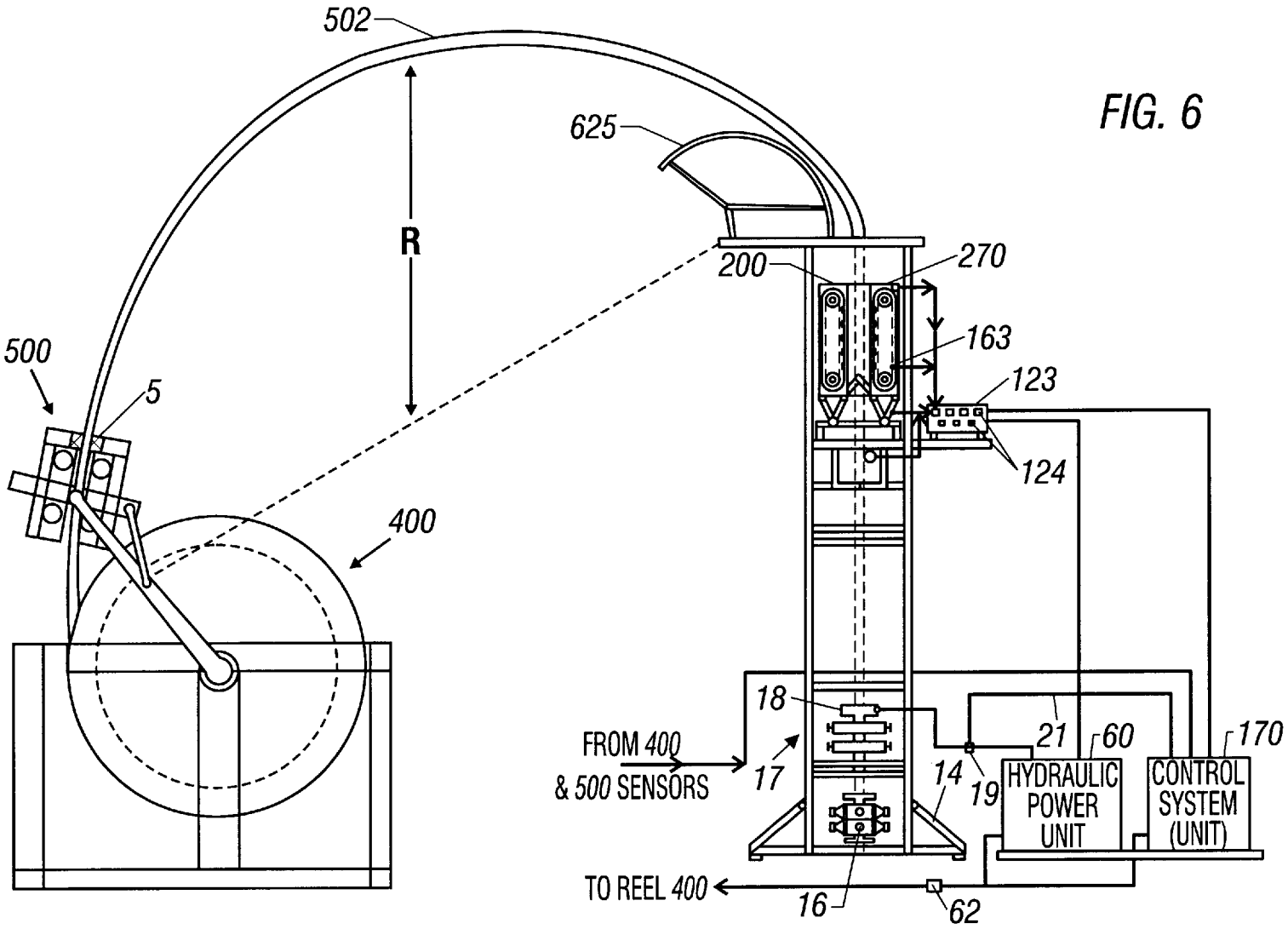
FIG. 6 shows a schematic diagram of a tubing injection system that utilizes the injector shown in FIGS. 5A and 5D in land operations.

FIG. 6 shows a schematic diagram of a tubing injection system that utilizes the injector 500 described in reference to FIGS. 5A and 5D. For the purposes of explanation, FIG. 6 shows a land tubing injection system 600, which, however, may readily be utilized for offshore operations. For simplicity and not as a limitation, reference numerals used in reference to FIG. 6 are same as used in FIGS. 1 and FIGS. 5A–5D for the same elements. The tubing injection system 600 includes the tubing source 400 having the tubing 502 spooled thereon and the reel injector 500 placed at a suitable location above source 400 for moving the tubing 502 to and from the source 400 as described in reference to FIGS. 5A–5D above. It should be noted that any other type of a suitable source and an injector, however, may be utilized for the purposes of this embodiment. The reel injector 400 feeds the tubing 502 into a second injector or in this case the main surface injector 200 (same as shown in FIGS. 1–3), which is placed on or above the wellhead equipment 17. Any other suitable injector, however, may be utilized as the main injector 200 for the purposes of this embodiment. For simplicity and ease of explanation, the remaining equipment, such as the hydraulic unit, control unit, electrically-operated valves, and the various sensors shown in FIGS. 1–3 are referred to by the same numerals, if shown, and if not shown are presumed to be included in the tubing injection system 600. Accordingly, the reference numerals utilized in FIGS. 1–3 are also used in reference to the tubing injection system 600. During operations, the tubing 502 passes from the source 400 to the injector 500. The bottom hole assembly (not shown) is then attached to the tubing end and passed through the main injector 200 in the manner described in reference to the injector head 200 of FIG. 1 or injector 190 of FIG. 2. The reel injector 500 is tilted to a desired angle and the injectors 500 and 200 are operated at preselected speeds so that the tubing 502 achieves a natural arch 604 of radius "R." The arch radius "R" is selected so as to maintain an equilibrium between the two injectors 500 and 630 and to maintain the natural arch to prevent plastic deformation of the tubing 502. A forty-five feet (45') radius is considered desirable. The system 600 is provided with a tubing guidance member, such as a gooseneck 625, which is preferably utilized in emergency situations, such as when the arch radius R suddenly becomes undesirably low. The remaining operation and controls are similar to the tubing injection system described in reference to FIG. 1.

Figure 7:
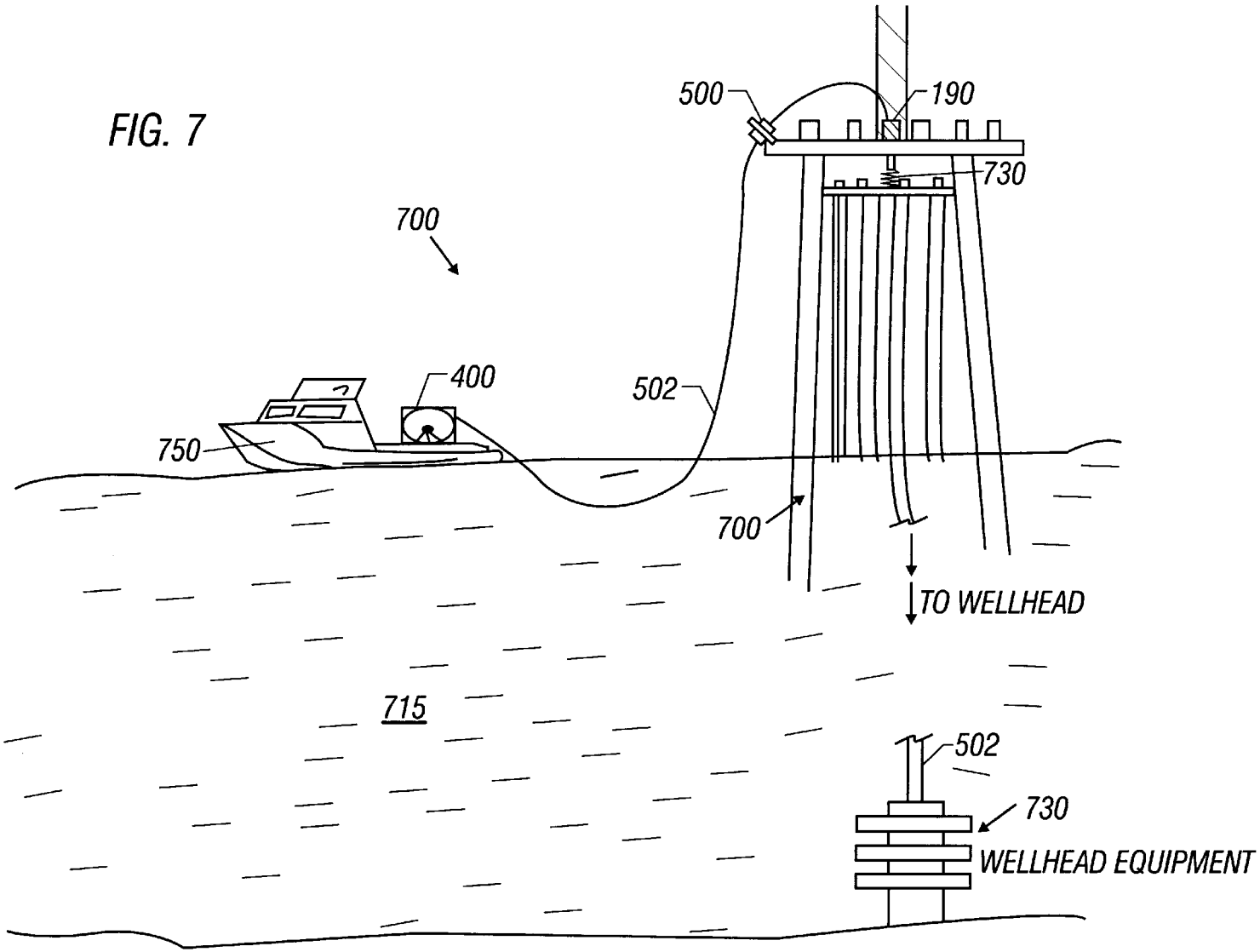
FIG. 7 shows a schematic diagram of a tubing injection system that utilizes the injector shown in FIGS. 5A and 5D in offshore operations.

FIG. 7 shows an embodiment of a tubing injection system 700 for offshore wellbore operations that utilizes the reel injector 500 shown in FIG. 5A. In this configuration, the reel injector 500 is suitably placed on an offshore platform 701 for moving the tubing 502 to and from a reel 400. The reel injector 500 feeds the tubing 702 to a surface injector 190 that is also placed on the offshore platform 701. The surface injector 190 moves the tubing 702 into the wellhead equipment 730 on the ocean floor preferably in the manner described in reference to FIG. 2. The injectors 500 and 190 operate in the manner injectors described above in reference to FIG. 6. If the offshore platform 701 has adequate space available, the tubing source 400 may be placed at the offshore platform 701. However, in many cases, space is limited on offshore platforms and since tubing sources are generally very large (as much as forty feet in diameter and several feet in length and width), the reel 400 may be placed on a relatively small separate vessel 750, which vessel can also be used to transport the tubing to and from the platform 701. When the tubing source 400 is placed on a platform 750 other than the offshore platform 701, the tubing 502 preferably moves from the reel 400 into the water 715 and then to the reel injector 500. Water 715 provides natural buoyancy to the tubing 502 without inducing undue stress into the tubing 502.

Figure 8:
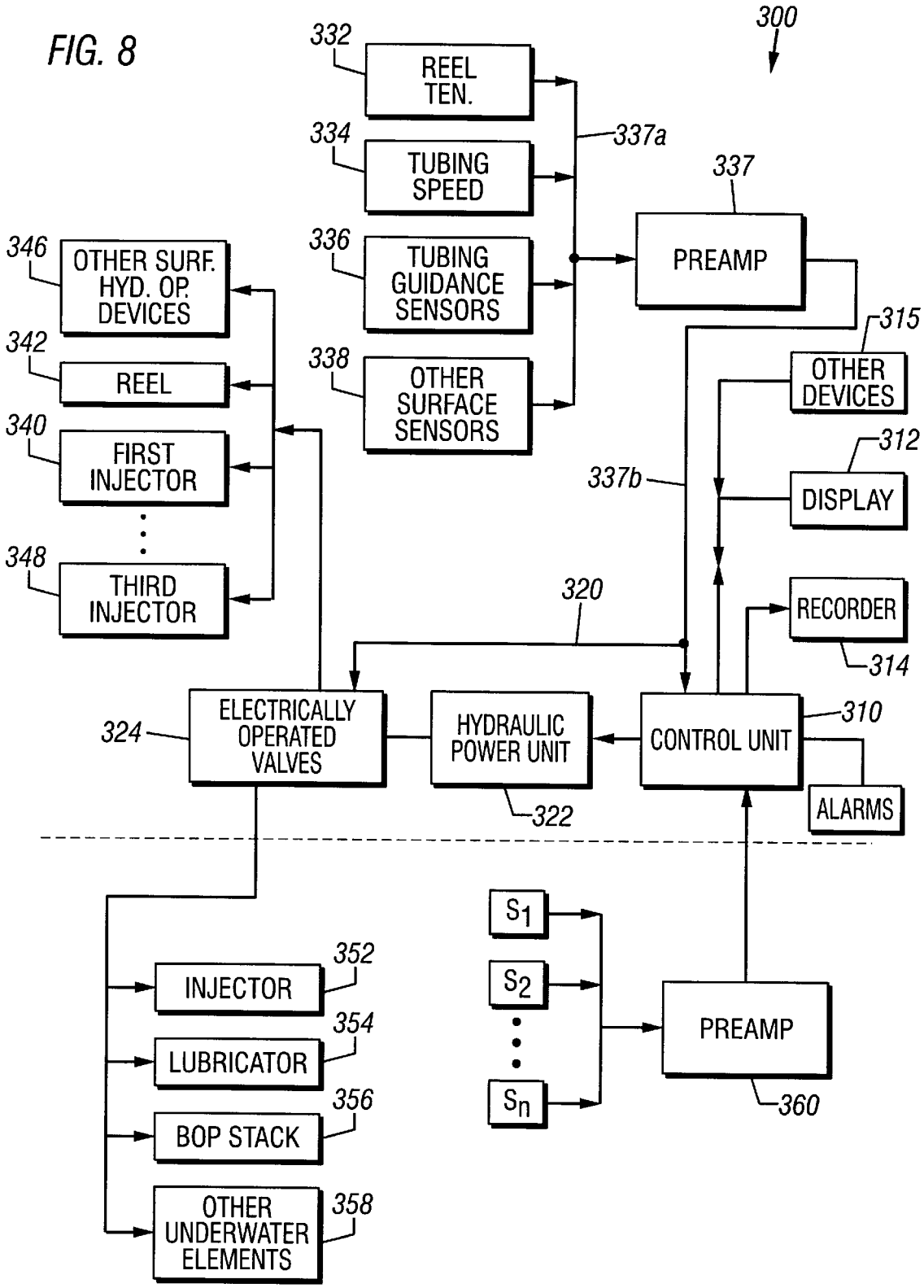
FIG. 8 shows a block functional diagram of a control system for controlling the operation of the tubing injection systems shown in FIGS. 1 and 2.

FIG. 8 shows a generic block functional diagram of the interconnection and operation of the various elements of tubing injection systems 10 and 100 respectively shown in FIGS. 1 and 2. The electrically-operated fluid control valves, generally shown by box 324, are coupled to the various surface and/or subsea hydraulically-operated devices. The surface hydraulically-operated devices may include surface injectors 340 and 348, reel 342 and any other devices, which are generally denoted herein by box 346. The subsea hydraulically-operated devices may include the subsea injector 352, pumps and other devices associated with the lubricator 354, the blow-out-preventor 356, and other subsea devices, generally denoted herein by box 358. The various sensors in the system, whether placed underwater or at the surface, provide signals directly or after pre-processing to the control unit 310. The surface sensors may include sensors for determining the tubing speed 334, reel tension 332, sensors placed in the tubing guidance system 336 and any other desired sensors. Other sensors are generally denoted herein as $S_1$–$S_n$ and may include sensors for determining the chain tension and the width of the opening of the injector, wellhead pressure and sensors for determining other operating parameters. The control unit 310 computes the values of the various operating parameters of the systems 10 or 100 as the case may be in response to the information provided by the various sensors and programmed instructions. The control unit 310 controls the operation of the various devices in response to the computed parameters and instructions provided to the control unit 310. The control unit 310 may be programmed to periodically or continually update selected operating parameters of the systems 10 or 100 and cause the operation to shut down and/or activate one or more alarms when one or more of the operating conditions is unsafe or undesirable. The control unit 310 can operate the systems 10 and 100 to provide optimal handling of the tubing 142.

The system 10 and 100 of the present invention may be programmed to automatically perform the tubing injection and removal operations for the specific tubing used for a given operation or it may be operated manually. In the present system, substantially all of the operation is performed from the control unit 170, which is conveniently located at a safe distance from the other tubing injection equipment, thus providing a relatively safer working environment. In the automatic mode, the control unit 310 is provided a program or model that defines the operating parameters of the system 300. The operating parameters may include the tubing speed when the bottom hole assembly passes through an injector head, through the wellhead equipment, when the bottom hole assembly is being transported to a predefined location within the wellbore and the injection speed during the drilling. The tubing injection speed during drilling is computed based on the available drilling parameters such as the rock formation, the type of drilling assembly used, wellbore conditions, etc. The control unit 320 then initiates the tubing injection operation, continuously receives the signals from the various sensors in the system 300, processes the received signals and other information provided to it and in response thereto controls the operation of the system 300 according to the programmed instructions. If any one or more of the selected parameters cannot be maintained within their desired ranges, the control system may be programmed to shut down the operation of the system 300 and/or activate the alarm 313. The control unit also may be programmed to continuously or periodically update the program based on signals received from one or more sensors utilized in the bottom hole assembly and at the surface. Further operation of the tubing injection system is then performed according to the updated program or model. This in-situ update of the tubing injection parameters allows more efficient drilling of the wellbores. Automated tubing injection and retrieval operations provide greater control over the operations compared to the known prior art systems. The systems of the present invention also require fewer persons to operate the systems compared to the prior art systems.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A tubing injection system for use in an underwater wellbore, comprising:

(a) a first injector placed underwater to move a tubing into the wellbore;

(b) a second injector to move the tubing from a source thereof to the first injector; and (c) at least one sensor associated with the tubing injection system for providing signals representative of a parameter relating to the tubing injection system for use in controlling operation of at least one of the first and second injectors.

2. The tubing injection system according to claim 1 further comprising a riser between the first and second injectors to guide the tubing between the first and second injectors.

3. The tubing injection system according to claim 2, wherein the first injector is placed on a wellhead, which comprises:

(i) a stuffing box below the first injector, the stuffing box providing a seal around the tubing when the tubing passes through the stuffing box; and (ii) a lubricator between the wellbore and the stuffing box, the lubricator having a control valve that enables discharging fluids accumulated in the lubricator.

4. The tubing injection system according to claim 1, wherein the tubing is selected from a group consisting of (i) coiled-tubing and (ii) jointed tubulars.

5. The tubing injection system according to claim 1, wherein the first injector includes a device that securely holds and moves the tubing through the first injector.

6. The tubing injection system according to claim 5, wherein the device to securely hold and move the tubing includes at least two gripping members to hold the tubing and an endless chain operated by a motor to move the tubing through the first injector.

7. The tubing injection system according to claim 6, wherein the motor and the at least two gripping members are sealed from water.

8. The tubing injection system according to claim 1 further comprising a plurality of electrically-operated fluid control valves associated with the first injector for controlling the flow of a pressurized fluid to a plurality of hydraulically-operated devices associated with the first injector.

9. The tubing injection system according to claim 8, wherein the electrically-operated fluid control valves are placed under water near the first underwater injector.

10. The tubing injection system according to claim 8 further comprising a hydraulic power unit for supplying pressurized fluid to the plurality of electrically-operated fluid control valves, the hydraulic power unit controlling the flow of a pressurized fluid to a plurality of devices associated with the first injector.

11. The tubing injection system according to claim 1 further comprising a control unit for controlling operation of at least one of said first and second injectors.

12. The tubing injection system according to claim 11, wherein the control unit shuts down the operation of the first injector when speed of the tubing passing therethrough is greater than a predefined limit.

13. The tubing injection system according to claim 1 wherein the at least one sensor is selected from a group consisting of (i) a sensor for monitoring tension, (ii) a sensor for determining speed of the tubing, (iii) a sensor for determining slippage of the tubing, (iv) a sensor for indicating size of opening in one of the first and second, (v) a sensor for determining force on the tubing, and (vi) a weight measuring sensor.

14. The tubing injection system according to claim 1, further comprising a third injector, said third injector moving the tubing between the source of the tubing and the second injector.

15. The tubing injection system according to claim 14, wherein the third injector maintains tension of the tubing within a predetermined range.

16. The tubing injection system according to claim 14, wherein the second and third injectors are placed on an offshore platform.

17. The tubing injection system according to claim 1 wherein the parameter relating to said tubing infection system is selected from a group consisting of: (i) tension (ii) speed; (iii) slippage, (iv) opening of one of the first and second injectors, (v) force on the tubing, and (vi) weight.

18. A method for moving a tubing from a source thereof into a subsea wellbore, comprising:

(a) providing a first injector under water for moving the tubing into the wellbore;

(b) providing a second injector at the surface for moving the tubing between the source and the first injector; and (c) providing a sensor for determining a parameter for controlling the operation of at least one of said first and second injectors.

19. The method of claim 18 further comprising deactivating the second injector after the tubing has passed through the first injector.

20. The method of claim 18 further comprising providing a third injector at the surface for moving the tubing from the source to the second injector.

21. The method of claim 18 further comprising providing a control unit operatively coupled to the first injector for controlling the operation of the first injector.

22. The method of claim 18, wherein providing a sensor comprises selecting the sensor from a group consisting of: (i) a sensor for monitoring tension; (ii) a sensor for determining speed of the tubing; (c) a sensor for determining slippage; (iv) a sensor for indicating size of opening in one of the first and second injectors; (v) a sensor for determining force on the tubing; and (vi) a weight measuring sensor.

23. A tubing injection system for moving a tubing from a source thereof into a wellbore, comprising:

(a) a first injector to move the tubing to and from the source; and (b) a second injector spaced apart from the first injector, the second injector receiving the tubing from the first injector and moving the received tubing into and out of the wellbore; and;

(c) at least one sensor associated with said tubing injection system for providing signals representative of a parameter relating to said tubing injection system for use in controlling operation of at least one of said first and second injectors.

24. The tubing injection system according to claim 23, wherein the first injector feeds the tubing into the second injector at a predetermined angle.

25. The tubing injection system according to claim 23, wherein the first injector feeds the tubing to the second injector in a manner that maintains a desired arch of the tubing between the first and second injectors.

26. The tubing injection system according to claim 25, wherein the first injector maintains the desired arch by adjusting at least one of (i) speed and (ii) angle of the tubing leaving the first injector.

27. The tubing infection system according to claim 23 containing a sensor selected from a group of sensors consisting of (a) a force measuring sensor for determining the angle of the tubing passing through the first injector, (b) sensor for measuring the speed of the tubing wherein the at least one sensor is selected from a group consisting of (i) sensor for monitoring tension; (ii) a sensor for determining speed of the tubing; (iii) a sensor for determining slippage of the tubing; (iv) a sensor for indicating size of opening in one of the first and second injectors; (v) a sensor for determining force on the tubing; and (vi) a weight measuring sensor.

28. The tubing injection system according to claim 23, wherein the source of the tubing is placed on a first offshore platform and at least one of the first and second injectors is placed on a second offshore platform.

29. The tubing injection system according to claim 28, wherein a portion of the tubing between the source and the first injector remains in water during normal operations.

30. The tubing injection system according to claim 23, wherein the first injector has associated therewith a plurality of force measuring sensors, each such force measuring sensor having an associated operating range, and wherein the apparatus adjusts the operation of the first injector so as to maintain each such force measuring sensor within its associated operating range.

31. The tubing injection system according to claim 23 further comprising a control unit for controlling operation of at least one of the first and second injectors.

32. The tubing injection system according to claim 31, wherein the control unit controls a parameter of the tubing injection system that is selected from a group consisting of (i) speed of the tubing; (ii) angle of release of the tubing from the first injector; (iii) force on the tubing; and (iv) tension of the tubing.

33. The tubing injection system according to claim 31, wherein the control unit includes a computer that controls the operation of the at least one of the first and second injectors in response to measurements made by the sensor in accordance with a program provided to the computer.

34. The tubing injection system according to claim 33, wherein the program is based at least in part on a drilling parameter selected from a group consisting of (i) weight on bit, (ii) rate of penetration, (iii) drill bit rotation speed, and (iv) dimensions of a drilling assembly utilized for drilling a wellbore.

35. The apparatus according to claim 31, wherein the control unit includes a computer to automatically operate at least one of the first and second injectors to inject the tubing into the wellbore according to a predefined injection rate profile.

36. The method according claim 31 further comprising providing a control unit for controlling the operation of the first and second injectors.

37. The method according to claim 36 further comprising providing a program to the control unit, said program defining a tubing injection profile.

38. The method according to claim 37, wherein the tubing injection profile defines the rate of injection of the tubing into the wellbore.

39. The method according to claim 37, wherein the control unit automatically causes the first and second injectors to inject the tubing into the wellbore according to the program.

40. The tubing injection system according to claim 23 further comprising a control unit, said control unit including a computer that controls operation of the first and second injectors in response to measurement made by a plurality of sensors associated with tubing injection system and in accordance with a program provided to the computer.

41. The tubing injection system according to claim 40, wherein the program is based on drilling parameters selected from a group consisting of (i) weight on bit, (ii) rate of penetration, (iv) drill bit rotation speed, and (v) dimensions of a drilling assembly utilized for drilling a wellbore.

42. A method of moving a tubing from a source thereof into a wellbore, comprising:

(a) moving the tubing from the source thereof by a first injector;

(b) moving the tubing from the first injector into the wellbore by a second injector; and (c) measuring a parameter of said tubing injection system by a sensor provided for said system for controlling operation of at least one of said first and second injectors.

43. The method according to claim 42 further comprising:

providing a computer for controlling the operation of the first and second injectors according to a predefined program.

44. The method according to claim 43, wherein the program defines a predetermined rate of injection of the tubing into the wellbore.

45. An automated method of injecting a tubing from a source thereof into a wellbore, comprising:

(a) providing a program, said program containing a tubing injection profile;

(b) providing at least one injector for moving the tubing from the source into the wellbore; and (c) providing a computer associated with the at least one injector, said computer automatically controlling the at least one injector to inject the tubing into the wellbore according to the tubing injection profile.

46. The method according to claim 45, wherein the computer adjusts the tubing injection profile as a function of an operating parameters.

47. The method according to claim 45, wherein the tubing is injected into the wellbore to perform a desired operation in the wellbore and wherein the tubing injection profile is determined based on a parameters relating to the desired operation.

48. The method according to claim 47, wherein the desired operation is drilling of the wellbore and the parameter rate of penetration.

* * * * *